US012540013B2

(12) United States Patent
Weaver et al.

(10) Patent No.: US 12,540,013 B2
(45) Date of Patent: Feb. 3, 2026

(54) TAMPER EVIDENT FLIP TOP CLOSURE

(71) Applicant: BERRY GLOBAL, INC., Evansville, IN (US)

(72) Inventors: Benson P. Weaver, Lititz, PA (US); Michael M. Makhlouf, Lititz, PA (US); Frank A. Bond, York, PA (US); Steven Gift, Lititz, PA (US)

(73) Assignee: BERRY GLOBAL, INC., Evansville, IN (US)

( * ) Notice: Subject to any disclaimer, the term of this patent is extended or adjusted under 35 U.S.C. 154(b) by 113 days.

(21) Appl. No.: 18/384,187

(22) Filed: Oct. 26, 2023

(65) Prior Publication Data

US 2024/0140654 A1 May 2, 2024

Related U.S. Application Data

(60) Provisional application No. 63/419,818, filed on Oct. 27, 2022.

(51) Int. Cl.

| | |
|---|---|
| ***B65D 47/08*** | (2006.01) |
| ***B65D 39/00*** | (2006.01) |
| ***B65D 41/34*** | (2006.01) |
| ***B65D 43/16*** | (2006.01) |
| ***B65D 50/04*** | (2006.01) |
| ***B65D 53/02*** | (2006.01) |
| ***B65D 55/02*** | (2006.01) |
| ***B65D 55/16*** | (2006.01) |

(52) U.S. Cl.

CPC ..... *B65D 41/3419* (2013.01); *B65D 43/169* (2013.01); *B65D 53/02* (2013.01); *B65D 55/16* (2013.01); *B65D 2251/1066* (2013.01); *B65D 2251/205* (2013.01)

(58) Field of Classification Search

CPC ..... B65D 41/3419; B65D 43/169; B65D 43/0235; B65D 47/0838; B65D 47/0804; B65D 53/02; B65D 55/16; B65D 55/024; B65D 55/0863; B65D 2251/1066; B65D 2251/205; B65D 2401/15; B65D 2401/00; B65D 2401/20; B65D 2401/60; B65D 41/3423

USPC ..... 206/527, 807; 215/237, 235, 250, 251, 215/254, 216, 901; 222/153.06; 220/266

See application file for complete search history.

(56) References Cited

U.S. PATENT DOCUMENTS 4,424,910 A * 1/1984 Heinol ..... B65D 50/045 215/237
4,711,363 A * 12/1987 Marino ..... B65D 47/0847 220/834

(Continued)

FOREIGN PATENT DOCUMENTS

DE 20118537 U1 * 12/2002 ..... B65D 47/0838
JP 3320898 B2 * 9/2002 ..... B65D 47/0814

OTHER PUBLICATIONS

International (PCT) Search Report and Written Opinion for PCT/US23/77877 dated Mar. 5, 2023, 9 pages.

*Primary Examiner* — Gideon R Weinerth
(74) *Attorney, Agent, or Firm* — Barnes & Thornburg LLP

(57) ABSTRACT

A package includes a container and a closure coupled to the container to control release of product therefrom. The closure includes a closure body coupled to the container and a flip-top cap coupled to the closure body and configured to pivot relative to the closure cap between a closed position and an opened position.

18 Claims, 6 Drawing Sheets

(56) References Cited

U.S. PATENT DOCUMENTS 4,711,372 A * 12/1987 Gach ..... B65D 47/0885 222/23
4,821,898 A * 4/1989 Smalley ..... B65D 55/02 215/253
4,852,770 A * 8/1989 Sledge ..... B65D 50/045 222/546
4,854,459 A * 8/1989 DeJonge ..... B65D 50/041 215/220
4,892,208 A * 1/1990 Sledge ..... B65D 47/0819 215/235
4,940,167 A * 7/1990 Fillmore ..... B65D 50/045 215/237
4,941,580 A 7/1990 Julian
6,234,334 B1 * 5/2001 Suarez ..... B65D 41/3409 222/541.6
6,269,986 B1 * 8/2001 Gross ..... B65D 47/0804 222/153.06
12,167,989 B2 * 12/2024 Gift ..... A61J 1/1437
2006/0011573 A1 * 1/2006 Herald ..... B65D 55/024 215/237
2007/0125741 A1 * 6/2007 Keung ..... B65D 50/046 215/237
2008/0073348 A1 3/2008 Pritikin
2011/0056982 A1 * 3/2011 Swanick ..... B65D 51/222 222/83
2012/0067922 A1 3/2012 Benoit-Gonin
2012/0211505 A1 * 8/2012 Vollers ..... B65D 47/0838 220/833
2012/0279966 A1 11/2012 Mazurkiewicz
2014/0034663 A1 * 2/2014 Konigseder ..... B65D 43/22 220/835
2014/0312038 A1 * 10/2014 van Alfen ..... B65D 50/00 220/214
2015/0266632 A1 9/2015 Kieffer
2018/0134469 A1 5/2018 Faria
2021/0039843 A1 2/2021 Kouba
2021/0078773 A1 * 3/2021 Berge ..... B65D 41/0428
2023/0063077 A1 * 3/2023 Gift ..... B65D 50/06
2024/0140654 A1 * 5/2024 Weaver ..... B65D 55/16
2025/0256894 A1 * 8/2025 Clerx ..... B65D 47/0809

* cited by examiner

TAMPER EVIDENT FLIP TOP CLOSURE

PRIORITY CLAIM

This application claims priority under 35 U.S.C. § 119(e) to U.S. Provisional Application Ser. No. 63/419,818, filed Oct. 27, 2022, which is expressly incorporated by reference herein in its entirety.

BACKGROUND

The present disclosure relates to packages, and particularly to packages including a closure. More particularly, the present disclosure relates to a package having a closure that can change between an opened position and a closed position.

SUMMARY

According to the present disclosure, a package includes a container and a closure coupled to the container to control release of product from the container. The closure includes a closure body coupled to the container and a flip-top cap coupled to the closure body. The flip-top cap is configured to pivot relative to the closure body between a closed position and an opened position.

In illustrative embodiments, the closure body includes an outer body sidewall, an inner body sidewall having a tab-locking segment spaced radially inward from the outer sidewall, and a body top wall formed to include a tab-receiving aperture opening into a space positioned radially between the outer body sidewall and the tab-locking segment. The flip-top cap includes a retainer tab having a cap-lifting segment, a breakaway segment extending away from the cap-lifting segment and through the tab-receiving aperture when the flip-top cap is in the closed position, and a frangible border connecting the breakaway segment to at least one of the cap-lifting segment and a cap sidewall of the flip-top cap.

In illustrative embodiments, the flip-top cap is configured to change from an unused, closed configuration to a first-use, opened configuration. In the unused, closed configuration the breakaway segment is coupled to at least one of the cap-lifting segment and the cap sidewall by the frangible border. In the first-use, opened configuration, the breakaway segment is separated from at least one of the cap-lifting segment and the cap sidewall after rotation of the flip-top cap about a cap pivot axis to provide tamper evidence. The outer body sidewall and the tab-locking segment also cooperate to retain the breakaway segment inside the space after the breakaway segment is separated from the flip-top cap so that the package can be recycled as one piece after all product is removed from the container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective and diagrammatic view of a package, in accordance with the present disclosure, showing that the package includes a container and a closure coupled to the container to control release of product therefrom;

FIG. 2 is an enlarged perspective view of the closure showing that the closure includes a closure body formed to include a discharge aperture and a flip-top cap coupled to the closure body in an unused, closed configuration blocking access to the discharge aperture, the flip-top cap including a tamper-evident retainer tab extending through a tab-receiving aperture formed in the closure body prior to consumer use of the package;

FIG. 3 is an enlarged perspective view of the closure of FIGS. 1 and 2 showing the flip-top cap in a first-use, opened configuration allowing access to the discharge aperture, and showing that the retainer tab includes a breakaway segment which separates from the rest of the retainer tab and the flip-top cap after the package is opened by a consumer for the first time to provide tamper evidence to consumers;

Figure 1:
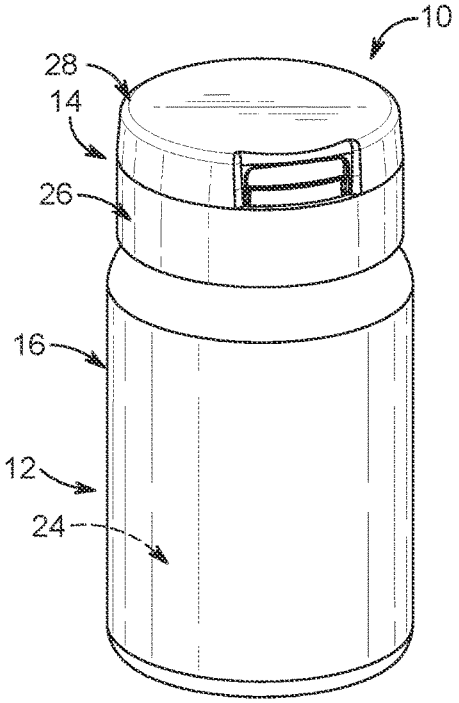
Figure 3:
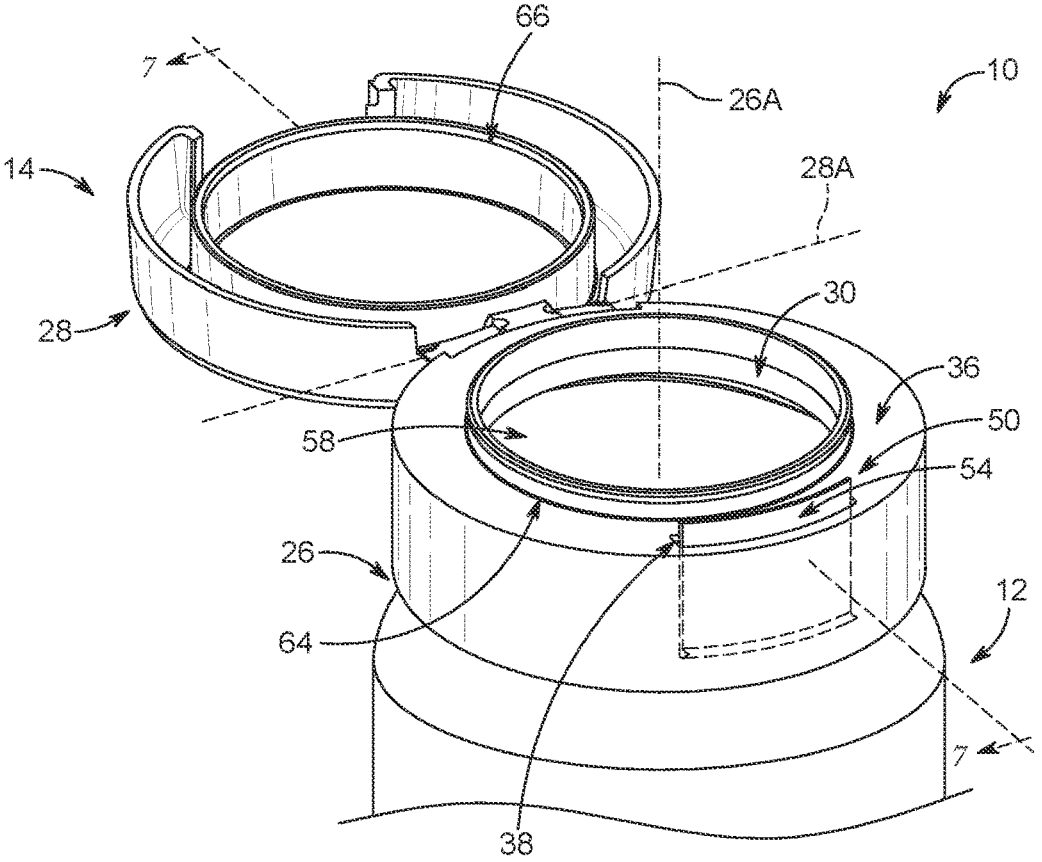
Figure 5A:
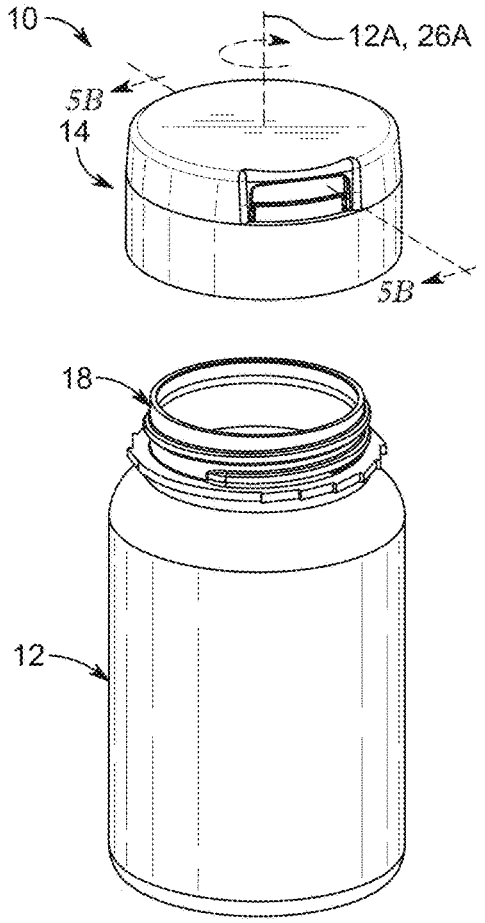
FIG. 5A is an exploded view of the package of FIG. 1 showing the closure separated from the container in a pre-installation configuration.
Figure 5B:
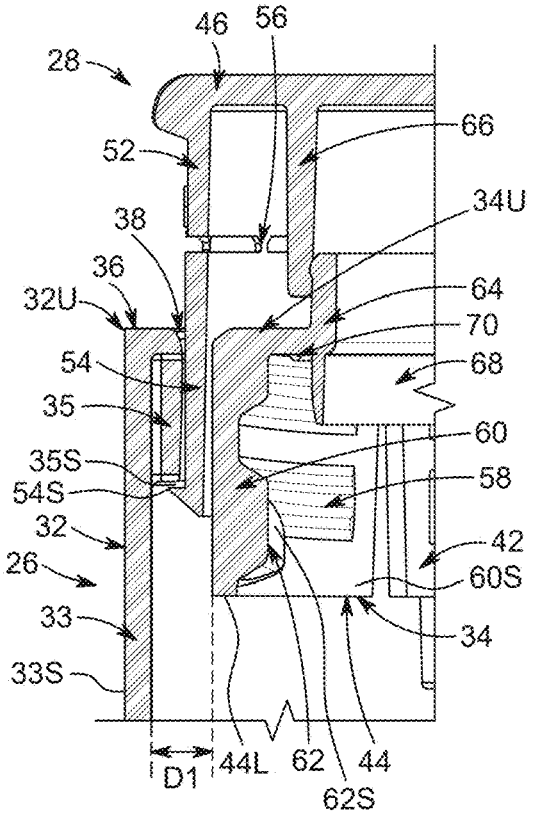
Figure 6A:
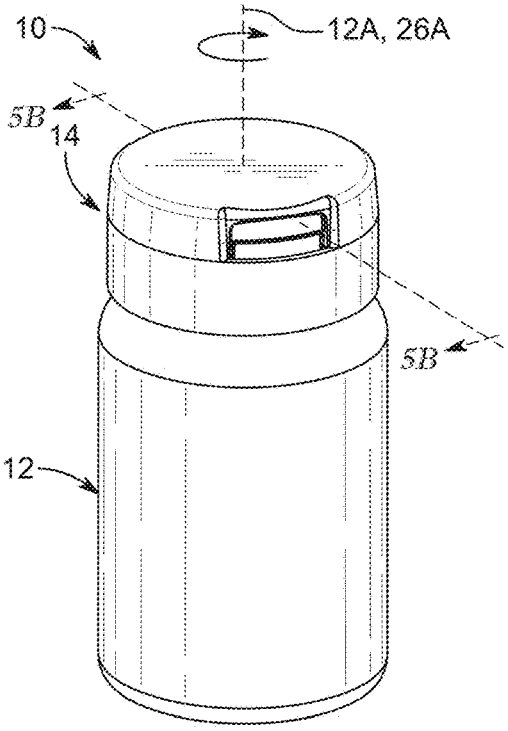
Figure 6B:
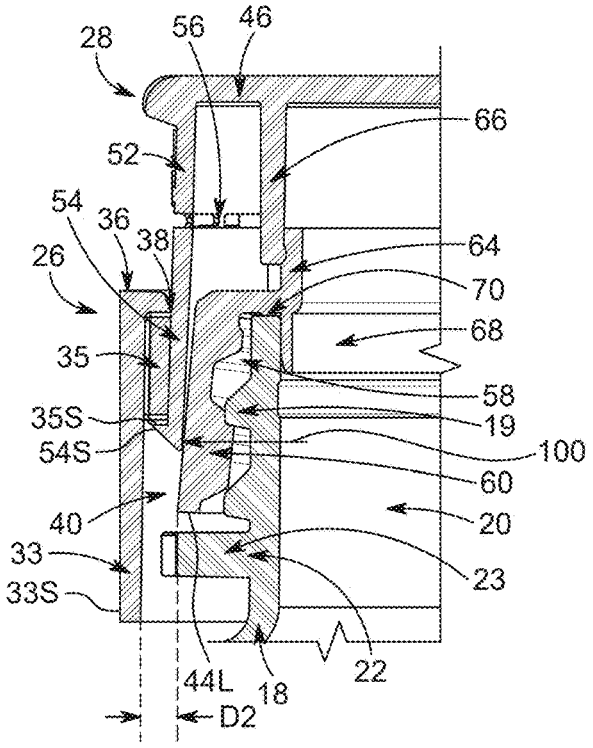
Figure 7:
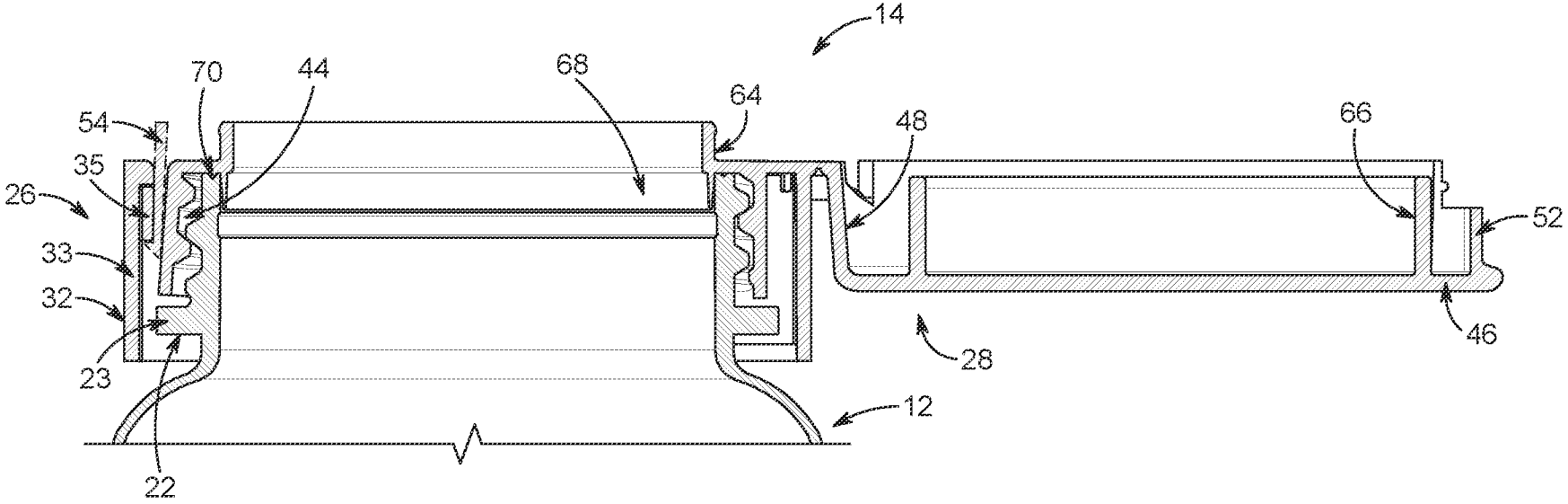
Figure 8:
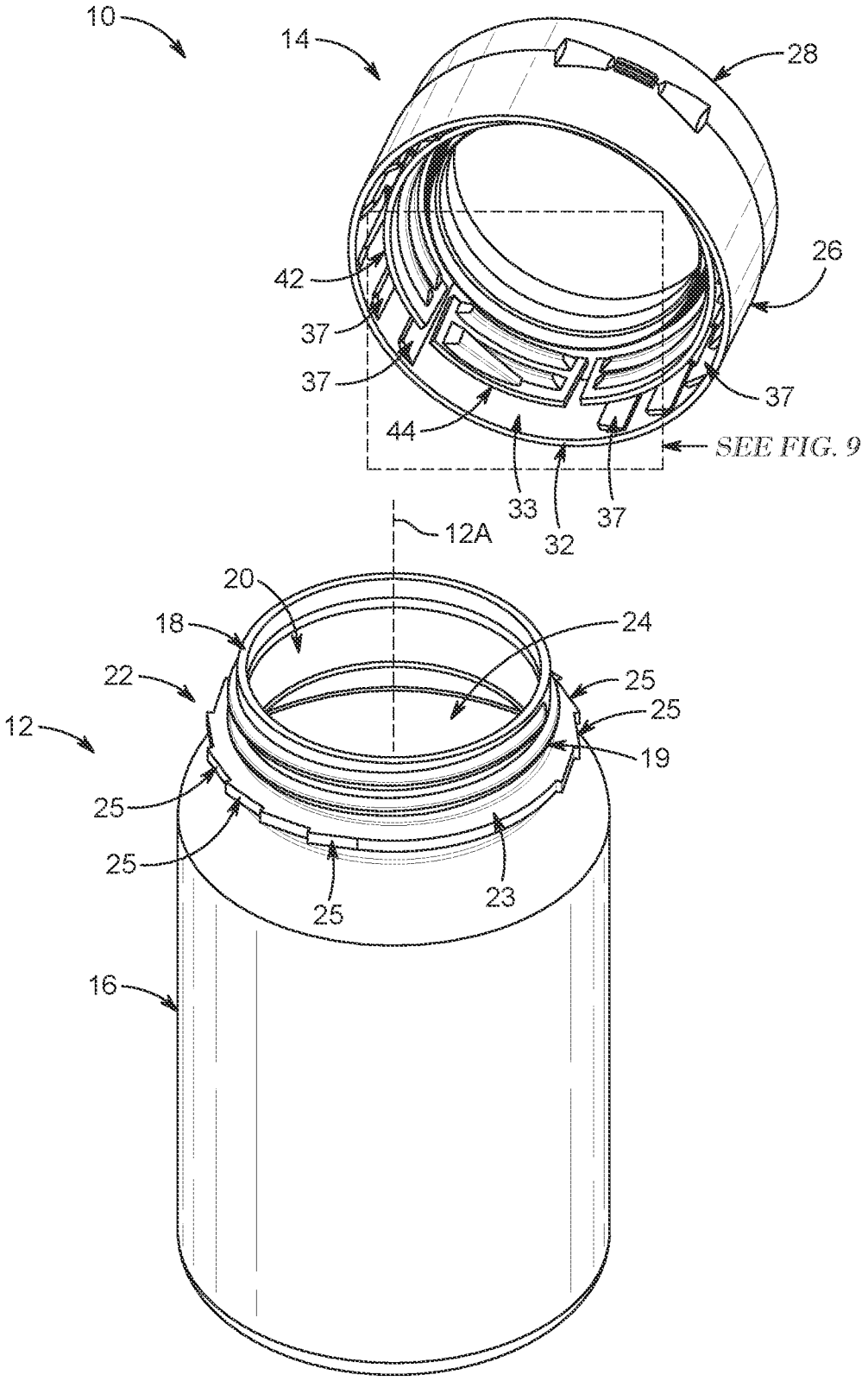
Figure 9:
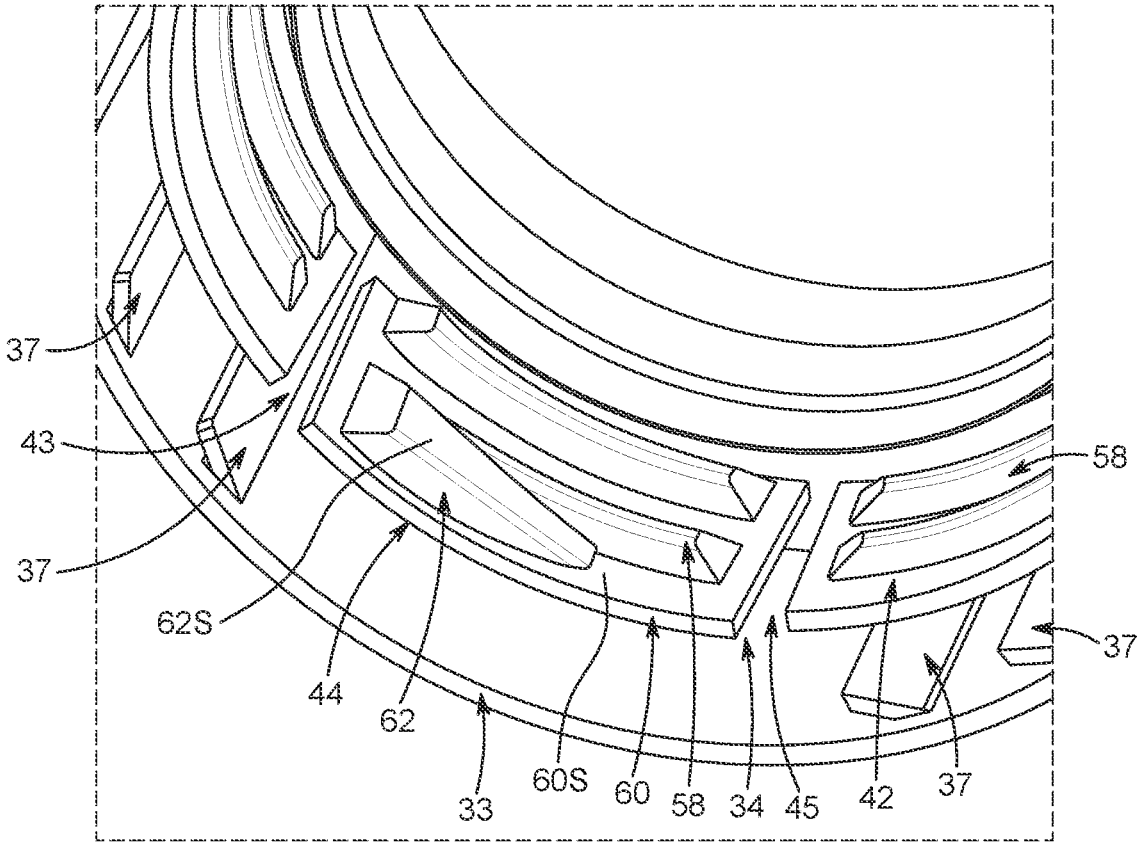

FIG. 5B is an enlarged section view taken along line 5B-5B in FIG. 5A showing the closure in the pre-installation configuration in which the breakaway segment of the retainer tab is received in the tab-receiving aperture after pivoting the flip-top cap from the initial, unused opened position to the unused, closed configuration, and showing that the closure body includes an outer body sidewall, an inner body sidewall, and a top wall formed to include the tab-receiving aperture located radially between the outer and inner body sidewalls;

FIG. 6A is a perspective view of the package of FIG. 1 showing the closure in a container-installation configuration in which the closure is screwed onto the container;

FIG. 6B is an enlarged section view taken along line 6B-6B in FIG. 6A showing the closure in the container-installation configuration and a tab-locking segment of the inner body sidewall pushed radially outward toward the outer body sidewall and to urge the breakaway segment of the retainer tab into locking engagement with the outer body sidewall so that the breakaway segment remains between the outer body sidewall and the inner body sidewall when the flip-top cap is opened for the first time as shown in FIG. 7;

FIG. 7 is a section view taken along line 7-7 in FIG. 3 showing the flip-top cap in the first-use, opened configuration;

FIG. 8 is an exploded view of the package of FIG. 1 showing that the container includes a filler neck and a closure retainer extending radially outward from the filler neck, the closure retainer including a plurality of rotation-blocking teeth, and showing that the closure body includes a plurality of rotation-blocking tabs configured to engage the plurality of rotation-blocking teeth so that rotation of the closure about a central axis of the container in a removal direction is blocked when the closure is in the container-installation configuration; and FIG. 9 is an enlarged view of the closure of FIG. 8 showing that the outer body sidewall includes the plurality of rotation-blocking tabs and showing that the tab-locking segment includes a ramp having a sloped surface adapted to engage external threads of a filler neck of the container to push the tab-locking segment towards the outer body sidewall.

DETAILED DESCRIPTION

A package 10 in accordance with the present disclosure includes a container 12 and a closure 14 configured to be mounted on the container 12 as shown in FIG. 1. The container 12 includes a container body 16 and a filler neck 18 formed to include a mouth 20. The filler neck 18 includes external threads 19 configured to correspond with threads of the closure 14 to install the closure 14 onto the filler neck 18. The mouth 20 opens into an interior product-storage region 24 defined by the container body 16 and the filler neck 18. The closure 14 is configured to mount to the filler neck 18 of the container 12 to close the mouth 20 defined by the filler neck 18 opening into the interior product-storage region 24. The closure 14 controls release of product from the container 12.

Figure 2:
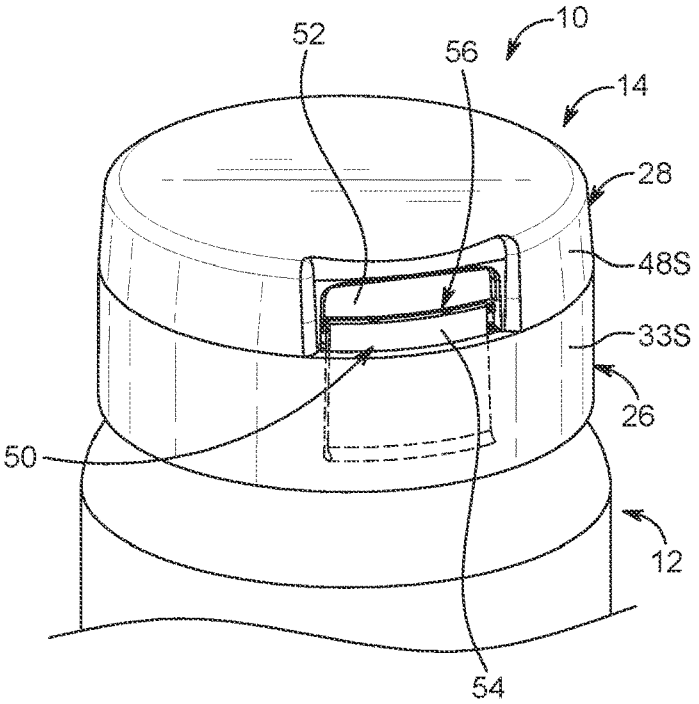

The closure 14 may be opened and closed by a user to allow access to and block access to product inside the interior product-storage region 24, respectively, as shown in FIGS. 2 and 3. The closure 14 includes a closure body 26 and a flip-top cap 28 coupled to the closure body 26. The closure body 26 is configured to engage with the filler neck 18 to retain the closure 14 to the container 12 and is formed to include a discharge aperture 30. The flip-top cap 28 is mounted to the closure body 26 for pivotable movement about a cap pivot axis 28A between an unused, closed configuration blocking access to the discharge aperture 30, as shown in FIG. 2, and a first-use, opened configuration allowing access to the discharge aperture 30, as shown in FIG. 3.

The flip-top cap 28 includes a retainer tab 50 that is used to initially retain the flip-top cap 28 in the unused, closed configuration as shown in FIG. 2 and that alerts consumers when the package 10 has been opened by providing tamper evidence in the first-use, opened configuration as shown in FIG. 3. In the unused, closed configuration the retainer tab 50 of the flip-top cap 28 is received in a tab-receiving aperture 38 formed in the closure body 26. In the first-use, opened configuration a portion of the retainer tab 50 separates from the rest of the flip-top cap 28 and remains in the tab-receiving aperture 38. The retainer tab 50 of the flip-top cap 28 visually indicates that the package 10 has been opened when the flip-top cap 28 is changed from the unused, closed configuration and the first-use, opened configuration and the portion of the retainer tab 50 is separated from the flip-top cap 28. Additionally, the closure body 26 retains the portion of the retainer tab 50 captured in the tab-receiving aperture 38 so that the package 10 can be recycled as one piece.

Figure 4:
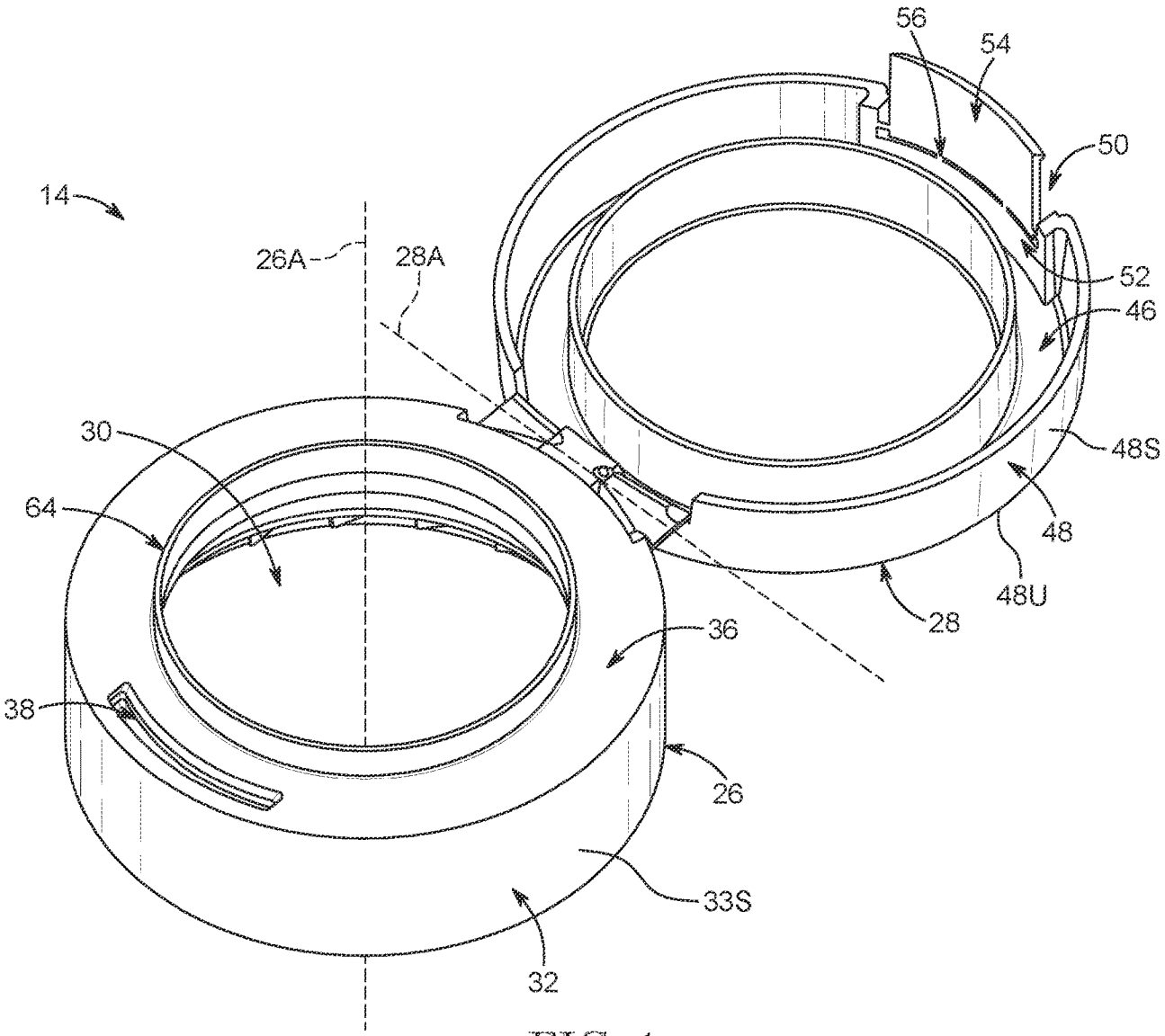
FIG. 4 is a perspective view of the closure separated from the container and the flip-top cap arranged in an unused, opened configuration following manufacture of the closure and prior to the retainer tab being received in the tab-receiving aperture.

The closure 14 may be manufactured with the flip-top cap 28 in an unused, opened configuration where the retainer tab 50 is fully attached to the flip-top cap 28 and the flip-top cap is spaced apart from the discharge aperture 30 as shown in FIG. 4. After manufacture and before installation onto the filler neck 18 of the container 12, the flip-top cap 28 is pivoted about the cap pivot axis 28A to change the flip-top cap 28 to the unused, closed configuration. The retainer tab 50 is inserted into the tab-receiving aperture 38 and locks on to the closure body 26 to block unintended opening of the flip-top cap 28.

In the illustrative embodiment, the closure 14 is made from high-density polyethylene (HDPE). HDPE is a relatively flexible material, but may be more recyclable than other stiffer materials that typically form items like closure 14. Because of the flexibility of HDPE, it may be difficult to form locking features or tamper evident features as the HDPE material can be easily deformed to defeat such features. The closure 14 in the illustrative embodiment is configured to deform upon installation on container 12 so that the tamper evident retainer tab 50 functions as intended despite being formed from HDPE and being flexible. In some embodiments, the closure 14 is made from polypropylene, which may also be more flexible than other materials. In some embodiments, the container 12 is made from HDPE or polypropylene. In some embodiments, the package 10 includes HDPE. In some embodiments, the package 10 consists of HDPE. In some embodiments, the package 10 consists essentially of HDPE. In some embodiments, the package 10 includes polypropylene. In some embodiments, the package 10 consists of polypropylene. In some embodiments, the package 10 consists essentially of polypropylene.

The closure 14 is configured to change from a pre-installation configuration shown in FIGS. 5A-5B to a container-installation configuration shown in FIGS. 6A-6B in response to being screwed onto container 12. In the pre-installation configuration, the closure 14 is separated from the container 12 and the retainer tab 50 of the flip-top cap 28 is received in the tab-receiving aperture 38 but may be removed from the tab-receiving aperture 38 without separating from the rest of the flip-top cap 28. In the container-installation configuration, the closure 14 is installed onto the container 12 and the closure body 26 deforms to apply a load 100 on the retainer tab 50 to block removal of a portion of the retainer tab 50 from the tab-receiving aperture 38. The load 100 applied on the retainer tab 50 by the closure body 26 ensures that, upon rotation of the flip-top cap 28 about the cap pivot axis 28A, the portion of the flip-top cap 28 is separated from the flip-top cap 28 to provide tamper evidence to a consumer. The separated portion of the flip-top cap 28 remains in a space 40 defined by the closure body 26 so the package 10 can be recycled as one piece.

The closure body 26 is configured to secure the closure 14 to the filler neck 18 and includes an outer body sidewall 32, an inner body sidewall 34, and a body top wall 36 as shown in FIGS. 5B, 6B, and 7. The inner body sidewall 34 is spaced radially inward from the outer body sidewall 32 relative to a central axis 26A of the closure body 26. The body top wall 36 is coupled to an upper end 32U, 34U of both the outer body sidewall 32 and the inner body sidewall 34. The body top wall 36 is formed to include the tab-receiving aperture 38. The space 40 is positioned radially between the outer body sidewall 32 and the inner body sidewall 34.

The outer body sidewall 32 includes a shell wall 33 and a tab retainer 35 coupled to the shell wall 33 as shown in FIGS. 5B and 6B. The shell wall 33 provides a radially outer surface 33S of the closure body 26. The tab retainer 35 extends radially inward from the shell wall 33 toward the central axis 26A and includes a lower surface 35S configured to engage the retainer tab 50 of the flip-top cap 28 to block a portion of the retainer tab 50 from being removed from the space 40.

The inner body sidewall 34 includes a retainer segment 42 and a tab-locking segment 44 as shown in FIG. 5B. The retainer segment 42 and the tab-locking segment 44 of the inner body sidewall 34 both include internal threads 58 which correspond to the external threads 19 of the filler neck 18 to install the closure 14 onto the filler neck 18. The tab-locking segment 44 is spaced circumferentially from the retainer segment 42 about the central axis 26A of the closure body 26. The tab-locking segment 44 is also aligned circumferentially with the tab-receiving aperture 38. The inner body sidewall is formed to include a pair of vertical slots 43, 45 which separate the tab-locking segment 44 from the retainer segment 42 as shown in FIG. 9.

The tab-locking segment 44 is movable relative to the rest of the closure 14 when the closure 14 is installed on the container in the container-installation configuration as shown in FIG. 5B. The tab-locking segment 44 deforms radially outward away from axis 26A and into engagement with the retainer tab 50 to apply the load 100. The load 100 applied by the tab-locking segment 44 locks a portion of the retainer tab 50 to the lower surface 35S of the tab retainer 35 so that the portion of the retainer tab 50 breaks away from the rest of the flip-top cap 28 when the flip-top cap 28 is opened for the first time.

The flip-top cap 28 includes a cap top wall 46, a cap sidewall 48, and a retainer tab 50 as shown in FIG. 1-4. The cap top wall 46 is coupled to an upper end 48U of the cap sidewall 48. The cap sidewall 48 has an outer surface 48S, at least a portion of which is aligned radially with the outer surface 33S of the closure body 26 relative to the central axis 26A when the flip-top cap 28 is in the closed position. The retainer tab 50 is coupled to at least one of the cap sidewall 48 and the cap top wall 46 and extends into the tab-receiving aperture 38 of the closure body 26.

The retainer tab 50 includes a cap-lifting segment 52, a breakaway segment 54, and a frangible border 56. In the illustrative embodiment, the cap-lifting segment 52 is coupled to both the cap sidewall 48 and the cap top wall 46. The breakaway segment 54 extends away from the cap-lifting segment 52 and includes a tab-retaining surface 54S configured to engage the lower surface 35S of the tab retainer 35 when the flip-top cap 28 is in the closed position. In the illustrative embodiment, the frangible border 56 connects the breakaway segment 54 to both the cap-lifting segment 52 and the cap sidewall 48. In other embodiments, the frangible border 56 may connect the breakaway segment 54 to only one of the cap-lifting segment 52 and the cap sidewall 48. The breakaway segment 54 of the retainer tab 50 is configured to breakaway from the rest of the flip-top cap 28 after the flip-top cap 28 is initially opened to provide tamper evidence to a user.

In the unused, closed configuration, the breakaway segment 54 of the retainer tab 50 is received in the tab-receiving aperture 38 and is coupled to at least one of the cap-lifting segment 52 and the cap sidewall 48. In the first-use, opened configuration, the breakaway segment 54 is separated from the retainer cap-lifting segment 52 and the cap sidewall 48 and the flip-top cap 28 after a consumer opens the package 10 for the first time. The flip-top cap 28 may be reclosed after the breakaway segment 54 is detached from the cap-lifting segment 52 and the cap sidewall 48 in the first-use, opened configuration by rotating the flip-top cap 28 about the pivot axis 28A to block access to the discharge aperture 30 and product inside the interior product-storage region 24 to maintain freshness of the product.

The tab-locking segment 44 retains the breakaway segment 54 within the space 40 to provide tamper evidence to a user and to allow the package 10 to be recycled as one piece once all product is removed from the interior product-storage region 24. The tab-locking segment 44 includes a segment wall 60, the internal threads 58, and a ramp 62 coupled to an inner surface 60S of the segment wall 60 below the internal threads 58 as shown in FIGS. 5B, 6B, and 9. The ramp 62 includes a sloped surface 62S that extends radially inward toward the central axis 26A from the inner surface 60S of the segment wall 60 so that the sloped surface 62S engages the external threads 19 of the filler neck 19. The engagement of the external threads 19 and the sloped surface 62S pushes the tab-locking segment 44 radially outward towards the outer body sidewall 32 in the container-installation configuration to apply the load 100 on the retainer tab 50.

In the pre-installation configuration, the closure 14 is separated from the container 12 and the breakaway segment 54 of the retainer tab 50 is received in the tab-receiving aperture 38 as shown in FIGS. 5A and 5B. A lower end 44L of the tab-locking segment 44 is located a first radial distance D1 from the outer body sidewall 32 relative to the central axis 26A in the pre-installation configuration. In the container-installation configuration, the closure 14 is installed onto the container 12 and the sloped surface 62S of the ramp 62 engages the external threads 19 as shown in FIGS. 6A and 6B. The engagement of the sloped surface 62S and the external threads 19 pushes the tab-locking segment 44 of the inner body sidewall 34 radially outwardly relative to the central axis 26A towards the outer body sidewall 32. In this position, the lower end 44L of the tab-locking segment 44 is located a second radial distance D2 from the outer body sidewall 32 in the container-installation configuration relative to the central axis 26A. The second radial distance D2 is less than the first radial distance D1. The tab-retaining surface 54S of the breakaway segment 54 may engage the lower surface 35S of the tab retainer 35 in both the pre-installation configuration and the container-installation configuration.

The container 12 further includes a closure retainer 22 configured to block rotation of the closure 14 relative to the container 12 after installation of the closure 14 onto the filler neck 18 as shown in FIG. 8. The closure retainer 22 extends radially outward from the filler neck 18 relative to a central axis 12A of the container 12. The closure retainer 22 includes a closure-retainer ring 23 and a plurality of rotation-blocking teeth 25 extending radially outward from the closure-retainer ring 23. The plurality of rotation-blocking teeth 25 are configured to engage with a portion of the closure 14 when the closure 14 is installed on the container 12 to block rotation of the closure 14 relative to the container 12. The closure-retainer ring 23 may also help to block the breakaway segment 54 from falling out of the space 40 after the breakaway segment 54 is separated from the flip-top cap 28 so that the package 10 can be recycled as one piece after all product is removed from the interior product-storage region 24.

The outer body sidewall 32 further includes a plurality of rotation-blocking tabs 37 configured to engage the plurality of rotation-blocking teeth 25 as shown in FIGS. 8 and 9. The plurality of rotation-blocking tabs 37 extend radially inward from the shell wall 33 relative to the central axis 26A. When the plurality of rotation-blocking tabs 37 engage the plurality of rotation-blocking teeth 25, rotation of the closure 14 about the central axis of the container 12A in a removal direction is blocked.

The closure body 26 may further include a body-sealing wall 64 coupled to and extending axially away from the body top wall 36 relative to the central axis 26 as shown in FIGS. 3, 4, 5B, 6B, and 7. The body-sealing wall 64 defines the discharge aperture 30 and is located radially inward from the inner body sidewall 34. Similarly, the flip-top cap 28 may further include a cap-sealing wall 66 coupled to and extending axially away from the cap top wall 46. The cap-sealing wall 66 is positioned radially inward from the cap sidewall 48 and radially outward from the body-sealing wall 64 when the flip-top cap 28 is in the closed position. The cap-sealing wall 66 and the body-sealing wall 64 engage with one another to secure the flip-top cap 28 to the closure body 26 when flip-top cap 28 is reclosed after the breakaway segment 54 is separated from the flip-top cap 28.

The closure body 26 may further include an annular plug seal 68 and a rim sealer 70 as shown in FIGS. 5B, 6B, and 7. The annular plug seal 68 is formed on an inside surface of the body top wall 36 and is adapted to engage the filler neck 18 of the container 12 to seal between the closure 14 and the container 12. The annular plug seal 68 is positioned radially inward from the inner body sidewall 34 relative to the central axis 26A. The rim sealer 70 is also formed on an inside surface of the body top wall 36 and is adapted to engage a top end of the filler neck 18 to seal between the closure 14 and the container 12. The rim sealer 70 is positioned radially between the inner body sidewall 34 and the annular plug seal 68 relative to the central axis 26A.

The invention claimed is:

1. A package comprising a container and a closure coupled to the container to control release of product therefrom, the closure including a closure body coupled to the container and formed to include a discharge aperture and a flip-top cap coupled to the closure body and configured to pivot relative to the closure body between a closed position blocking access to the discharge aperture and an opened position allowing access to the discharge aperture, wherein the closure body includes an outer body sidewall, an inner body sidewall spaced radially inward from the outer sidewall relative to a central axis of the closure body and having a retainer segment and a tab-locking segment spaced circumferentially from the retainer segment relative to the central axis, and a body top wall coupled to an upper end of both the outer body sidewall and the inner body sidewall and formed to include a tab-receiving aperture opening into a space located radially between the outer body sidewall and the tab-locking segment of the inner body sidewall, wherein the flip-top cap includes a cap sidewall, a cap top wall coupled to an upper end of the cap sidewall, and a retainer tab including a cap-lifting segment coupled to at least one of the cap sidewall and the cap top wall, a breakaway segment extending away from the cap-lifting segment and through the tab-receiving aperture when the flip-top cap is in the closed position, and a frangible border connecting the breakaway segment to at least one of the cap-lifting segment and the cap sidewall, wherein the flip-top cap is configured change from an unused, closed configuration in which the breakaway segment of the retainer tab is coupled to at least one of the cap-lifting segment and the cap sidewall by the frangible border, to a first-use, opened configuration in which the breakaway segment is separated from at least one of the cap-lifting segment and the cap sidewall after rotation of the flip-top cap about a cap pivot axis to provide tamper evidence, and wherein the closure is configured to change from a pre-installation configuration, in which the closure is separated from the container and the breakaway segment of the retainer tab is in the unopened configuration, and a container-installation configuration, in which the closure is screwed onto the container and the tab-locking segment of the inner body sidewall is pushed radially outwardly towards the outer body sidewall so that the breakaway segment of the retainer tab remains between the outer body sidewall and the inner body sidewall when the breakaway segment of the retainer tab is installed in the tab-receiving aperture.

2. The package of claim 1, wherein a lower end of the tab-locking segment is a first radial distance from the outer body sidewall relative to the central axis of the closure when the closure is in the pre-installation configuration, the lower end of the tab-locking segment is a second radial distance from the outer body sidewall relative to the central axis of the closure when the closure is in the closure-installation configuration, and the first radial distance is greater than the second radial distance.

3. The package of claim 1, wherein the container includes a filler neck having external threads and both the tab-locking segment and the retainer segment of the inner body sidewall include internal threads that correspond to the external threads to install the closure on the filler neck.

4. The package of claim 1, wherein the outer body sidewall includes a shell wall and a tab retainer coupled to and extending radially inward of the shell wall relative to the central axis, and the breakaway segment of the retainer tab includes a tab-retaining surface adapted to engage a lower surface of the tab retainer in both the pre-installation configuration and the container-installation configuration.

5. The package of claim 1, wherein the container includes a filler neck and a closure retainer extending radially outward from the filler neck relative to a central axis of the container, the closure retainer including a closure-retainer ring and a plurality of rotation-blocking teeth extending radially outward from the closure-retainer ring and configured to engage with a portion of the closure when the closure is installed on the container to block removal of the closure from the container.

6. The package of claim 5, wherein the outer body sidewall of the closure includes a shell wall and a plurality of rotation-blocking tabs extending radially inward from the shell wall relative to the central axis of the closure, the plurality of rotation-blocking tabs of the outer body sidewall configured to engage the plurality of rotation-blocking teeth of the closure retainer so that rotation of the closure about the central axis of the container in a removal direction is blocked when the closure is in the container-installation configuration.

7. The package of claim 1, wherein the closure includes high-density polyethylene.

8. A package comprising a container and a closure coupled to the container to control release of product therefrom, the closure including a closure body coupled to the container and formed to include a discharge aperture and a flip-top cap coupled to the closure body and configured to pivot relative to the closure body between a closed position blocking access to the discharge aperture and an opened position allowing access to the discharge aperture, wherein the closure body includes an outer body sidewall, an inner body sidewall spaced radially inward from the outer sidewall relative to a central axis of the closure body and having a retainer segment and a tab-locking segment spaced circumferentially from the retainer segment relative to the central axis, and a body top wall coupled to an upper end of both the outer body sidewall and the inner body sidewall and formed to include a tab-receiving aperture opening into a space located radially between the outer body sidewall and the tab-locking segment of the inner body sidewall, wherein the flip-top cap includes a cap sidewall, a cap top wall coupled to an upper end of the cap sidewall, and a retainer tab including a cap-lifting segment coupled to at least one of the cap sidewall and the cap top wall, a breakaway segment extending away from the cap-lifting segment and through the tab-receiving aperture when the flip-top cap is in the closed position, and a frangible border connecting the breakaway segment to at least one of the cap-lifting segment and the cap sidewall, wherein the flip-top cap is configured change from an unused, closed configuration in which the breakaway segment of the retainer tab is coupled to at least one of the cap-lifting segment and the cap sidewall by the frangible border, to a first-use, opened configuration in which the breakaway segment is separated from at least one of the cap-lifting segment and the cap sidewall after rotation of the flip-top cap about a cap pivot axis to provide tamper evidence, wherein the container includes a filler neck having external threads and both the tab-locking segment and the retainer segment of the inner body sidewall include internal threads that correspond to the external threads to install the closure on the filler neck, and wherein the tab-locking segment includes a segment wall, the internal threads, and a ramp coupled to an inner surface of the segment wall below the internal threads.

9. The package of claim 8, wherein the ramp includes a sloped surface extending radially inward from the inner surface so that the sloped surface engages the external threads of the filler neck to push the tab-locking segment towards the outer body sidewall.

10. A closure configured to control release of product from a container, the closure comprising a closure body formed to include a discharge aperture and, a flip-top cap coupled to the closure body and configured to pivot relative to the closure body between a closed position blocking access to the discharge aperture and an opened position allowing access to the discharge aperture, wherein the closure body includes an outer body sidewall, an inner body sidewall spaced radially inward from the outer sidewall relative to a central axis of the closure body and having a retainer segment and a tab-locking segment spaced circumferentially from the retainer segment relative to the central axis, and a body top wall coupled to an upper end of both the outer body sidewall and the inner body sidewall and formed to include a tab-receiving aperture opening into a space positioned radially between the outer body sidewall and the tab-locking segment of the inner body sidewall, wherein the flip-top cap includes a cap sidewall, a cap top wall coupled to an upper end of the cap sidewall, and a retainer tab including a cap-lifting segment coupled to at least one of the cap sidewall and the cap top wall, a breakaway segment extending away from the cap-lifting segment and through the tab-receiving aperture when the flip-top cap is in the closed position, and a frangible border connecting the breakaway segment to at least one of the cap-lifting segment and the cap sidewall, wherein the flip-top cap is configured change from an unused, closed configuration in which the breakaway segment of the retainer tab is coupled to at least one of the cap-lifting segment and the cap sidewall by the frangible border, to a first-use, opened configuration in which the breakaway segment is separated from at least one of the cap-lifting segment and the cap sidewall after rotation of the flip-top cap about a cap pivot axis to provide tamper evidence, and wherein the closure is configured to change from a pre-installation configuration, in which the breakaway segment of the retainer tab is received in the tab-receiving aperture when the flip-top cap is in the closed position and the closure is separated from a container, and a container-installation configuration, in which the tab-locking segment of the inner body sidewall is pushed radially outwardly towards the outer body sidewall when the closure is screwed onto a container so that the breakaway segment of the retainer tab remains between the outer body sidewall and the inner body sidewall when the flip-top cap is in the closed position and the opened position.

11. The closure of claim 10, wherein a lower end of the tab-locking segment is a first radial distance from the outer body sidewall relative to the central axis of the closure when the closure is in the pre-installation configuration, the lower end of the tab-locking segment is a second radial distance from the outer body sidewall relative to the central axis of the closure when the closure is in the closure-installation configuration, and the first radial distance is greater than the second radial distance.

12. The closure of claim 10, wherein both the tab-locking segment and the retainer segment of the inner body sidewall include internal threads that correspond to external threads of a container to install the closure on the container.

13. The closure of claim 10, wherein the outer body sidewall includes a shell wall and a tab retainer coupled to and extending radially inward of the shell wall relative to the central axis, and the breakaway segment of the retainer tab includes a tab-retaining surface adapted to engage a lower surface of the tab retainer in both the pre-installation configuration and the container-installation configuration.

14. The closure of claim 10, wherein the outer body sidewall of the closure includes a shell wall and a plurality of rotation-blocking tabs extending radially inward from the shell wall relative to the central axis of the closure, the plurality of rotation-blocking tabs of the outer body sidewall configured to engage a plurality of rotation-blocking teeth of a container so that rotation of the closure about a central axis of a container in a removal direction is blocked when the closure is in the container-installation configuration.

15. The closure of claim 10, wherein the flip-top cap further includes a cap-sealing wall extending downward from the cap top wall relative to the central axis when the flip-top cap is in the closed position, the closure body further includes a body-sealing wall extending upward from the body top wall relative to the central axis and defining the discharge aperture, and wherein the cap-sealing wall and the body-sealing wall engage to seal the flip-top cap to the closure body in the closed position after the breakaway segment has separated from the flip-top cap.

16. The closure of claim 10, wherein the closure body further includes an annular plug seal adapted to engage a filler neck of a container to seal the closure body and the filler neck.

17. A closure configured to control release of product from a container, the closure comprising a closure body formed to include a discharge aperture and, a flip-top cap coupled to the closure body and configured to pivot relative to the closure body between a closed position blocking access to the discharge aperture and an opened position allowing access to the discharge aperture, wherein the closure body includes an outer body sidewall, an inner body sidewall spaced radially inward from the outer sidewall relative to a central axis of the closure body and having a retainer segment and a tab-locking segment spaced circumferentially from the retainer segment relative to the central axis, and a body top wall coupled to an upper end of both the outer body sidewall and the inner body sidewall and formed to include a tab-receiving aperture opening into a space positioned radially between the outer body sidewall and the tab-locking segment of the inner body sidewall, wherein the flip-top cap includes a cap sidewall, a cap top wall coupled to an upper end of the cap sidewall, and a retainer tab including a cap-lifting segment coupled to at least one of the cap sidewall and the cap top wall, a breakaway segment extending away from the cap-lifting segment and through the tab-receiving aperture when the flip-top cap is in the closed position, and a frangible border connecting the breakaway segment to at least one of the cap-lifting segment and the cap sidewall, wherein the flip-top cap is configured change from an unused, closed configuration in which the breakaway segment of the retainer tab is coupled to at least one of the cap-lifting segment and the cap sidewall by the frangible border, to a first-use, opened configuration in which the breakaway segment is separated from at least one of the cap-lifting segment and the cap sidewall after rotation of the flip-top cap about a cap pivot axis to provide tamper evidence, wherein both the tab-locking segment and the retainer segment of the inner body sidewall include internal threads that correspond to external threads of a container to install the closure on the container, and wherein the tab-locking segment includes a segment wall, the internal threads, and a ramp coupled to an inner surface of the segment wall below the internal threads.

18. The closure of claim 17, wherein the ramp includes a sloped surface extending radially inward from the inner surface so that the sloped surface engages external threads of a container to push the tab-locking segment towards the outer body sidewall.

* * * * *